US008628355B2

(12) United States Patent
Hirakawa

(10) Patent No.: US 8,628,355 B2
(45) Date of Patent: Jan. 14, 2014

(54) ELECTRICAL CONNECTOR AND ELECTRICAL CONNECTOR ASSEMBLY

(75) Inventor: Takeshi Hirakawa, Tokyo (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 0 days.

(21) Appl. No.: 13/520,288

(22) PCT Filed: Dec. 28, 2010

(86) PCT No.: PCT/JP2010/073784

§ 371 (c)(1),
(2), (4) Date: Jul. 24, 2012

(87) PCT Pub. No.: WO2011/086857

PCT Pub. Date: Jul. 21, 2011

(65) Prior Publication Data

US 2013/0012066 A1 Jan. 10, 2013

(30) Foreign Application Priority Data

Jan. 13, 2010 (JP) ..... 2010-004741

(51) Int. Cl.
*H01R 13/66* (2006.01)

(52) U.S. Cl.
USPC ..... 439/620.01

(58) Field of Classification Search
USPC ..... 439/620.01, 660, 676, 620.1, 489, 941, 439/76.1
See application file for complete search history.

(56) References Cited

U.S. PATENT DOCUMENTS 7,591,681 B1 * 9/2009 Zhang et al. ..... 439/620.24
7,666,001 B2 * 2/2010 Nishimura ..... 439/67
8,395,879 B1 * 3/2013 Gorst et al. ..... 361/274.1
8,413,323 B2 * 4/2013 Bresche et al. ..... 29/847
8,414,334 B2 * 4/2013 Nakayama et al. ..... 439/620.01

FOREIGN PATENT DOCUMENTS

| | | |
|---|---|---|
| JP | 62 5673 | 1/1987 |
| JP | 11 288770 | 10/1999 |
| JP | 2001 43939 | 2/2001 |
| JP | 2002 324636 | 11/2002 |

OTHER PUBLICATIONS

International Search Report Issued Jan. 25, 2011 in PCT/JP10/73784 Filed Dec. 28, 2010.

U.S. Appl. No. 13/577,323, filed Aug. 6, 2012, Hirakawa.

* cited by examiner

*Primary Examiner* — Jean F Duverne
(74) *Attorney, Agent, or Firm* — Oblon, Spivak, McClelland, Maier & Neustadt, L.L.P.

(57) ABSTRACT

[Problem]

To extremely simplify the configuration of an electrical connector by omitting a circuit board and an electrical connector, etc. of a mating counterpart.

[Solution]

A single plug connector 10 is directly mated with a wall part of a product chassis MF. In a mated state of the single plug connector 10, a contact part of a contact 12 is brought into contact with a contact part of a wiring pattern CP exposed from an inner-peripheral wall part of a mating hole MFa. Therefore, electrical connection of a signal transmission medium can be established by a simple configuration without the intermediation of a conventionally-used circuit board and an electrical connector serving as a mating counterpart mounted on the circuit board.

5 Claims, 8 Drawing Sheets

ELECTRICAL CONNECTOR AND ELECTRICAL CONNECTOR ASSEMBLY

TECHNICAL FIELD

The present invention relates to an electrical connector and an electrical connector assembly that electrically connect a terminal part of a signal transmission medium to a wiring pattern.

BACKGROUND ART

Generally, in various electronic devices or electrical devices such as mobile phones, a terminal part of each of various signal transmission media composed of, for example, thin coaxial cables, flexible wiring boards, or printed wiring boards has been commonly connected to a printed wiring board side by using an electrical connector (for example, see below-described Patent Literature 1). The electrical connector connects the terminal part of the signal transmission medium to a predetermined wiring pattern (circuit). Normally, for example as shown in FIG. 11, a receptacle connector 3 is mounted on a circuit board 2 attached to an inner part of a product chassis 1, and a plug connector 5, which is coupled to a terminal part of a signal transmission medium 4 composed of a thin coaxial cable or the like, is configured to be mated with the receptacle connector 3. The functions of the electrical connectors 3 and 5 used in this case are to carry out transmission of necessary information signals through signal lines and to connect a shield signal for grounding to a ground circuit through a shield line.

On the other hand, recently, reduction in size/thickness of electronic devices, etc. have been rapidly developed, and the height and cost of electrical connectors have been accordingly reduced. Therefore, simplifying the above described configuration of the electrical connectors 3 and 5 has been strongly required. In order to omit the receptacle connector 3, it is conceivable to directly solder a connection leg part of the plug connector 5 to an electrically conductive path on the product chassis 1. However, since the product chassis 1 is made of a resin molding material, the chassis has low thermal resistance, and this state does not allow direct soldering or mounting of an electronic part to the product chassis. Therefore, all of normally-used electrical connectors have a basic configuration that one of the electrical connectors (receptacle connector) 3 is mounted on the printed wiring board 2 having a wiring pattern and the other electrical connector (plug connector) 5 is in a state mated therewith. Due to restrictions of such a basic configuration, it is becoming difficult to significantly reduce the height and cost.

CITATION LIST

Patent Literature

Patent Literature 1: Japanese Patent Application Laid-Open No. 2001-43939

Patent Literature 2: Japanese Patent Application Laid-Open No. 2002-324636

DISCLOSURE OF THE INVENTION

Problems to be Solved by the Invention

Therefore, it is an object of the present invention to provide an electrical connector and an electrical connector assembly which are capable of significantly reducing the height and cost thereof by a simple configuration.

Means for Solving the Problems

In order to achieve the above described object, an electrical connector according to the present invention employs a configuration in which: a terminal part of a signal transmission medium is connected to a wiring pattern formed on a surface of a wall part of a product chassis constituting an electronic device having a predetermined circuit, a contact having a contact part elastically in contact with the wiring pattern is attached to an insulating housing; wherein the insulating housing is configured to be able to be inserted into and mated with a mating hole formed in the wall part of the product chassis, the wiring pattern is provided with a contact part exposed from an inner-peripheral wall surface of the mating hole, and the contact part of the contact is configured to be in contact with the contact part of the wiring pattern in a state that the insulating housing is mated with the mating hole.

An electrical connector assembly according to the present invention employs a configuration composed of a product chassis, which constitutes an electronic device having a predetermined electronic circuit and has a wiring pattern formed to transmit a signal onto a surface of the wall part, and the above described electrical connector.

According to such a configuration, the single connector is configured to be directly mated with the wall part of the product chassis. In the mated state of the single connector, the contact parts of the contact are brought into contact with the contact parts of the wiring pattern exposed from the inner-peripheral wall part of the mating hole. Therefore, electrical connection of the signal transmission medium can be established with a simple configuration without intermediation of a conventionally-used circuit board or electrical connector serving as a mating counterpart mounted on the circuit board.

Moreover, in the present invention, it is desired that the mating hole be formed so as to penetrate through the wall part of the product chassis, a lock part be engaged with an opening edge part of the mating hole is provided, and the lock part be disposed so as to be adjacent to the contact.

When such a configuration is employed, the contact part of the contact is stably supported by the lock part disposed in the vicinity thereof; therefore, the electric connection state of the contact is stably maintained.

In the present invention, it is desired that the lock part be formed so as to be extended along an extending direction of the signal transmission medium.

When such a configuration is employed, the retaining force of the lock parts is generated lengthwise along the extending direction of the signal transmission medium. Therefore, for example, the retainability against the load that lifts up and swings the signal transmission medium is enhanced, and the mating state of the connector is stably maintained.

It is desired that he contact in the present invention be composed of a signal contact for transmitting a signal and ground contacts for grounding disposed in both sides of the signal contact.

When such a configuration is employed, the ground contacts are disposed in both sides of the signal contact. Therefore, adjustment of impedance, etc. with respect to the signal contact is well performed.

Advantageous Effects of Invention

As described above, in the present invention, the single connector is configured to be directly mated with the wall part of the product chassis. In the mated state of the single connector, the contact part of the contact is brought into contact with the wiring pattern exposed to the inner-peripheral wall part of the mating hole. Therefore, the electric connection of the signal transmission medium is configured to be carried out by a simple configuration without the intermediation of a conventionally-used circuit board or an electrical connector serving as a mating counterpart mounted on the circuit board. Therefore, by omitting the circuit board and the electrical connector, etc. of the mating counterpart, the configuration of the electrical connector can be extremely simplified, and the height and cost of the electrical connector can be significantly reduced.

DESCRIPTION OF EMBODIMENT

Figure 1:
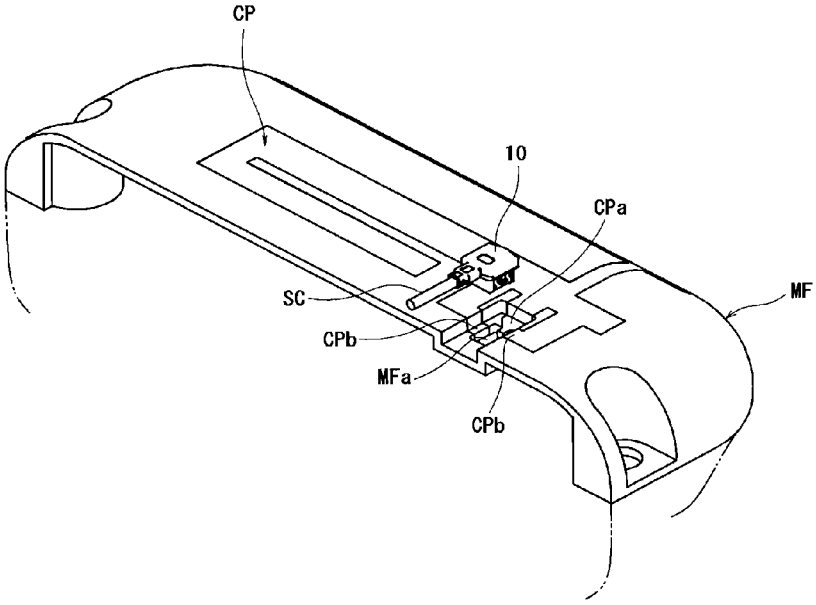
FIG. 1 is an appearance perspective explanatory view showing an intermediate state of a connecting operation using an electrical connector according to an embodiment of the present invention.
Figure 2:
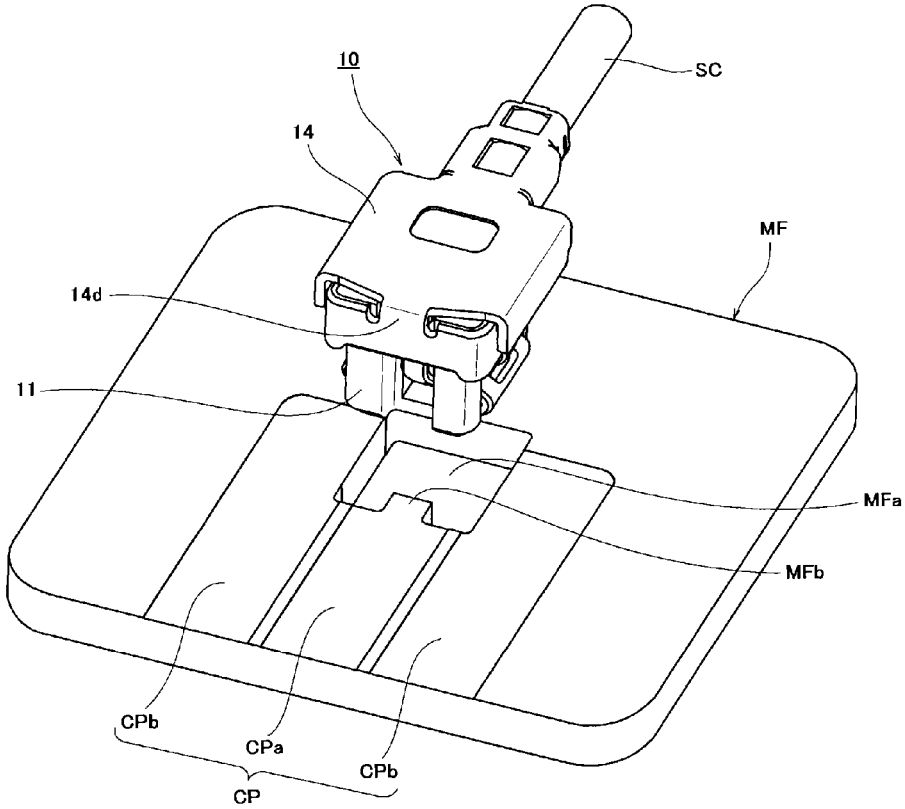
FIG. 2 is an appearance perspective explanatory view showing, from the front side, the state before a plug connector according to the embodiment of the present invention shown in FIG. 1 is mated with a mating hole.
Figure 3:
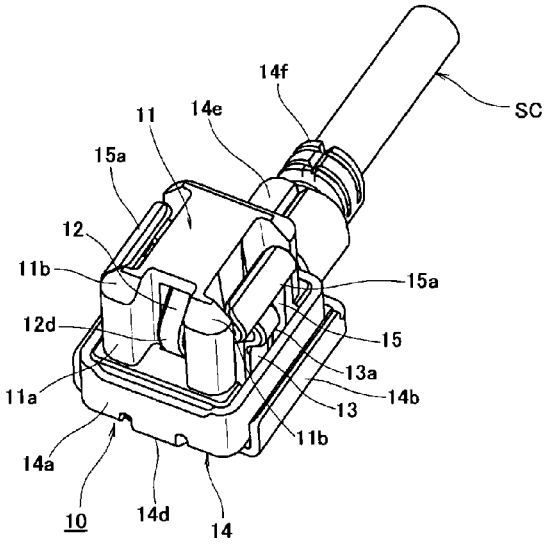
FIG. 3 is an appearance perspective explanatory drawing showing, from the lower side, the structure of the plug connector according to the embodiment of the present invention shown in FIG. 1 and FIG. 2.
Figure 4:
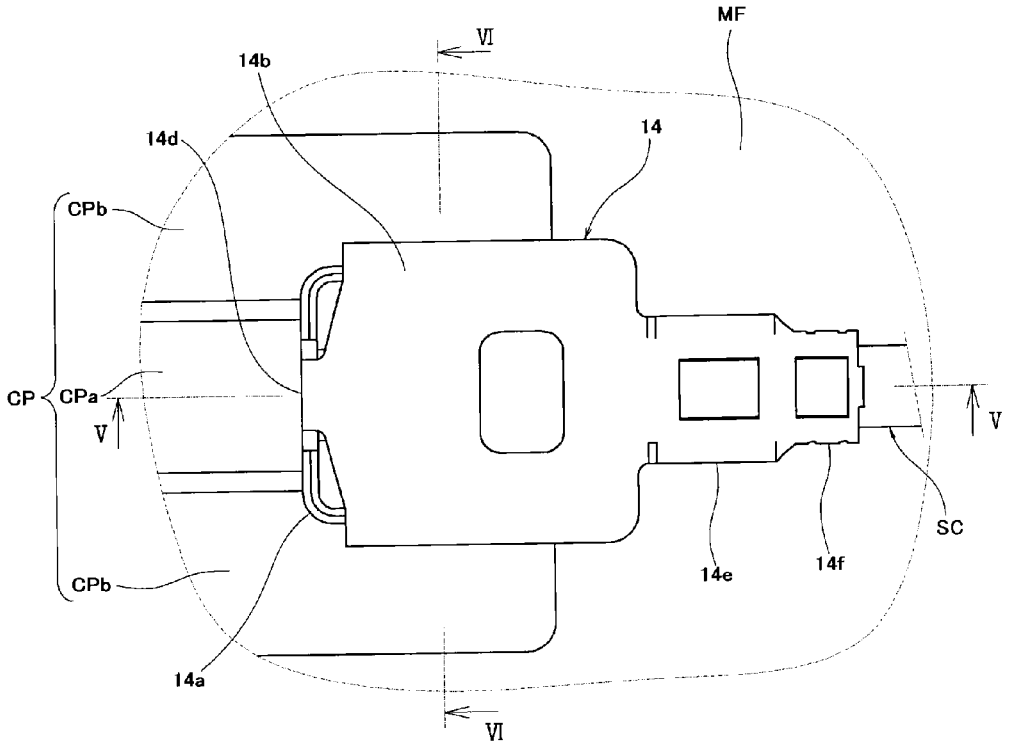
FIG. 4 is a plan explanatory view showing, from the upper side, the plug connector shown in FIG. 1 and FIG. 2.

Hereinafter, an embodiment of a case in which the present invention is applied to an electrical connector of a vertical mating type configured so as to be directly mated with a product chassis of an electronic device from the upper side by using a thin coaxial cable as a signal transmission medium will be described in detail based on drawings.

A plug connector 10 according to the embodiment of the present invention shown in FIG. 1 to FIG. 6 is configured so as to electrically connect a terminal part of a thin coaxial cable SC serving as a signal transmission medium to a wiring pattern (electrically conductive path) CP formed on a surface of a wall part of a product chassis MF, which constitutes an electronic device such as a mobile phone having a predetermined electronic circuit; and the wiring pattern CP, which constitutes part of an antenna or various circuits, is formed on the inner surface or outer surface of the wall part, which constitutes the product chassis MF, by printing or the like.

A mating hole MFa is formed in the wall part of the product chassis MF so as to penetrate through the wall part of the product chassis MF, and the plug connector 10 is configured to be mated with the mating hole MFa provided in the wall part of the product chassis MF. A terminal part of the thin coaxial cable SC serving as the signal transmission medium is coupled to the plug connector 10 in a manner described later; and, first, the plug connector 10, to which the thin coaxial cable SC is coupled, is disposed above the mating hole MFa so as to face the mating hole in the manner shown in FIG. 1 and FIG. 2. Then, the plug connector 10 disposed in the upper side thereof is moved down in a direction approximately orthogonal to the surface of the wall part of the product chassis MF and mated with the interior of the mating hole MFa so as to be inserted thereto in the manner shown in FIG. 5 and FIG. 6.

In the state in which the plug connector 10 is mated with the mating hole MFa of the product chassis MF in this manner, the terminal part of the thin coaxial cable SC is configured to be connected to the wiring pattern CP; wherein, the direction of inserting the plug connector 10 will be hereinafter referred to as a downward direction, and the removing direction of removing the plug connector 10 oppositely will be referred to as an upward direction.

In this case, the mating hole MFa formed in the wall part of the product chassis MF in the above described manner is formed of a cornered hole, which forms an approximately rectangular shape in a planar view; and a terminal part of an electrically-conductive signal path CPa of the above described wiring pattern CP is formed so as to extend from a first-end edge part which forms the opening of the mating hole MFa. Hereinafter, the first-end edge part of the mating hole MFa positioned in the side in which the electrically-conductive signal path CPa of the wiring pattern CP is extending will be referred to as "front-end edge part". Furthermore, electrically-conductive ground paths CPb of the wiring pattern CP are formed so as to be extended, from both-side edge parts adjacent to the first-end edge part (front-end edge part) of the mating hole MFa, approximately parallel along both sides of the electrically-conductive signal path. The electrically-conductive signal path CPa and the electrically-conductive ground paths CPb of the wiring pattern CP are formed so as to be exposed to an inner-peripheral wall surface of the mating hole MFa, and the part exposed to the inner-peripheral wall surface serves as a contact part.

A projected part MFb, which is projected into the hole, is provided at the first-end edge part (front-end edge part) of the above described mating hole MFa, and the plug connector 10 is configured to be inserted into the mating hole MFa by using the projected part MFb as a locator. A contact part of the electrically-conductive signal path CPa of the above described wiring pattern CP is formed on a projected end face of the projected part MFb provided at the front-end edge part of the mating hole MFa.

On the other hand, the plug connector 10 is configured as a vertical-mating-type connector which is mated with the mating hole MFa from the upper side in the above described manner, and the terminal part of the thin coaxial cable SC serving as an example of the signal transmission medium is coupled to the plug connector 10. Hereinafter, regarding the plug connector 10, the end edge part in the side to which the thin coaxial cable SC is coupled will be referred to as "rear-end edge part", and the end edge part in the opposite side thereof will be referred to as "front-end edge part". The front-end edge part of the plug connector 10 is aligned with the above described front-end edge part of the mating hole MFa, and the end edge part thereof in the opposite side of the front-end edge part of the mating hole MFa will be referred to as "rear-end edge part". Furthermore, the directions toward the rear-end edge part and the front-end edge part thereof will be referred to as "rear" and "front", respectively.

The above described terminal part of the thin coaxial cable SC serving as the signal transmission medium coaxially exposes a cable central conductor (signal line) SCa and a cable external conductor (shield line) SCb when an outer-peripheral covering material is peeled off, and a signal circuit is configured to be formed when the cable central conductor SCa disposed along the central axis line of the thin coaxial cable SC is connected to an electrically-conductive signal terminal (signal contact) 12 attached to an insulating housing 11. A ground circuit is configured to be formed when the cable exterior conductor SCb disposed so as to surround the outer-peripheral side of the above described cable central conductor SCa is connected to electrically-conductive ground terminals (ground contacts) 13, which is integrally provided with a later-described electrically-conductive shell 14.

The insulating housing 11 of such plug connector 10 has an insulating main-body part 11*a*, which retains the thin coaxial cable SC, the electrically-conductive signal terminal (signal contact) 12, and the electrically-conductive ground terminals (ground contacts) 13 in the above described manner. The insulating main-body part 11*a* is configured so as to be inserted into the mating hole MFa of the product chassis MF side, which is serving as a mating counterpart, from a lower end part of the insulating main body part 11*a*, and insertion guiding parts 11*b* composed of inclined surfaces are provided at lowermost end parts which are the insertion side of the insulating main-body part 11*a*.

Figure 7:
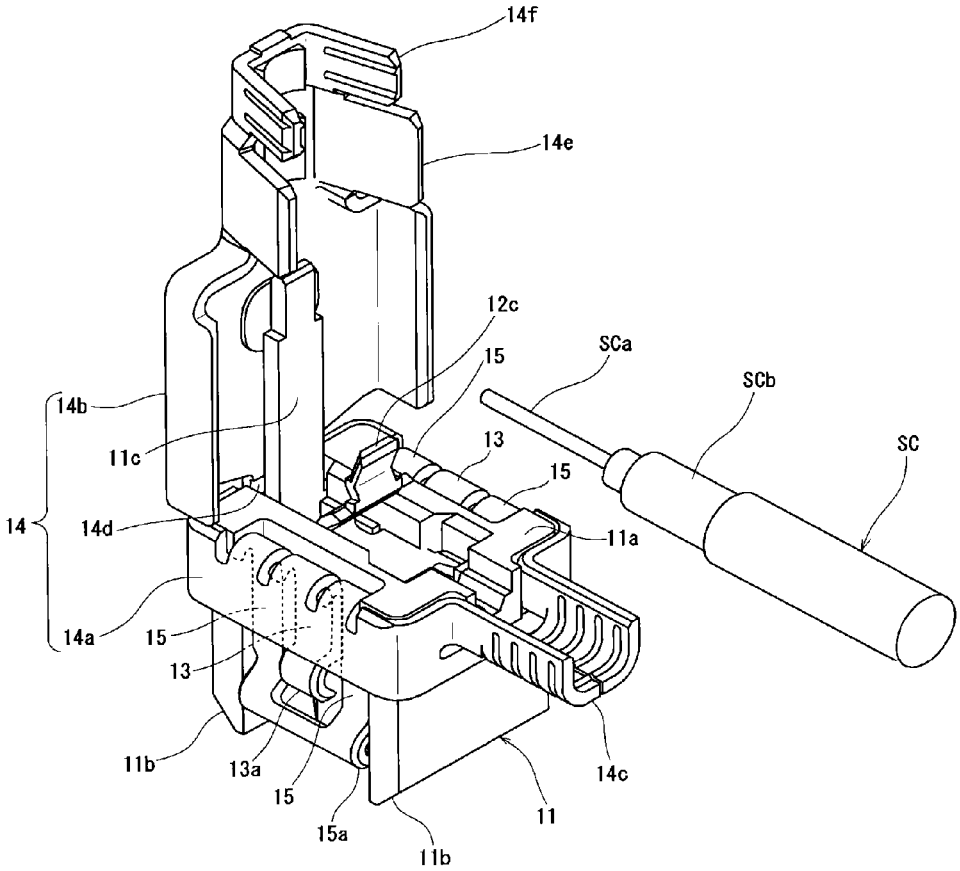
FIG. 7 is an appearance perspective explanatory view showing, from the rear side, the state before coupling a thin coaxial cable serving as a signal transmission medium with respect to the plug connector shown in FIG. 1 to FIG. 6.
Figure 8:
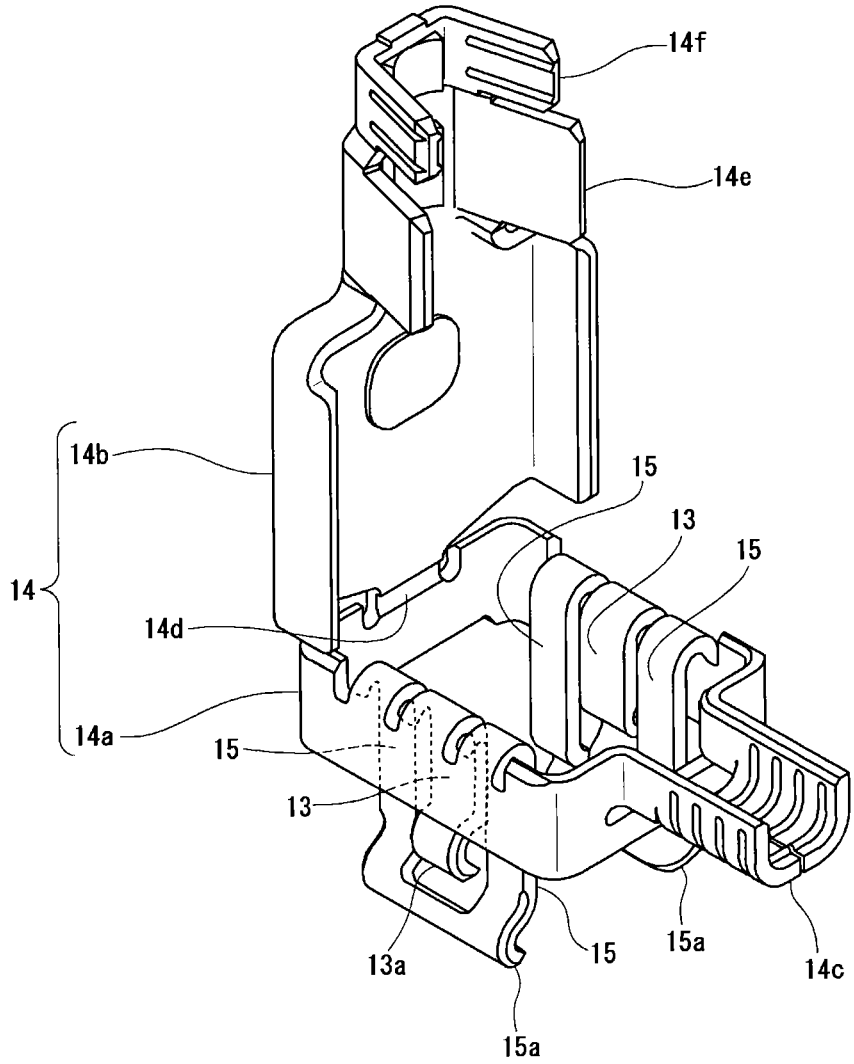
FIG. 8 is an appearance perspective explanatory view showing a single electrically-conductive shell used in the plug connector shown in FIG. 7.

The outer surface of the insulating main-body part 11*a* is covered with the electrically-conductive shell 14 composed of a member like a thin metal plate. Particularly as shown in FIG. 7 and FIG. 8, the electrically-conductive shell 14 is composed of a shell main-body part 14*a*, which circularly covers the outer-peripheral lateral surface of the insulating main-body part 11*a*, and a shell cover part 14*b*, which covers the upper surface part of the insulating main-body part 11*a*. Among these, in a rear end part of the shell main-body part 14*a*, a cable supporting part 14*c*, which forms an approximately semicircular shape in a transverse section, is provided so as to be approximately-horizontally projected toward the rear side, and the above described terminal part of the thin coaxial cable SC is configured to be placed on and received by the inner wall surface of the cable supporting part 14*c*.

Furthermore, in an initial state before coupling the above described terminal part of the thin coaxial cable SC, the shell cover part 14*b* of the electrically-conductive shell 14 is in an open state as shown in FIG. 7 and FIG. 8. In other words, the shell cover part 14*b* in the initial state is formed so as to rise upward approximately vertically via a thin coupling plate 14*d* in the opposite side of the above-described cable supporting part 14*c*, in other words, at the front-end part of the shell main-body part 14*a*. In the inner surface side of the coupling plate 14*d*, an insulating pressing plate 11*c* rising upward from the insulating main-body part 11*a* of the insulating housing 11 is disposed along it.

Figure 9:
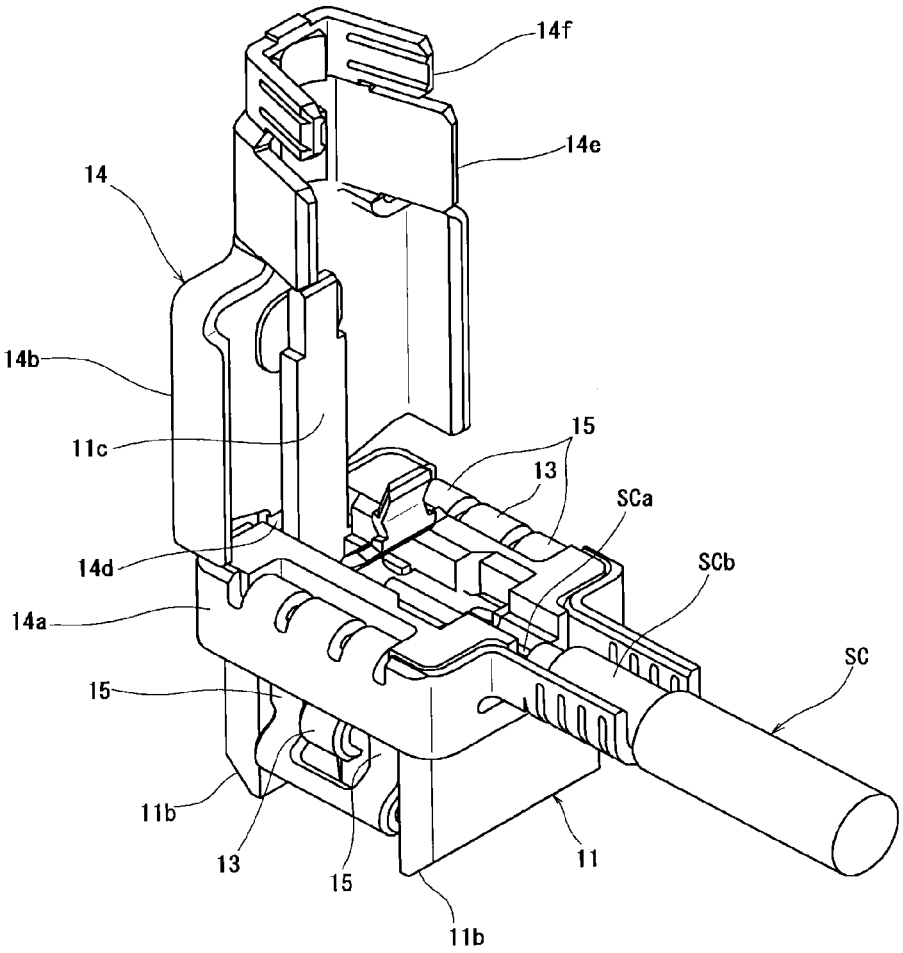
FIG. 9 is an appearance perspective explanatory view showing, from the rear side, the state in which the thin coaxial cable serving as the signal transmission medium is set with respect to the plug connector shown in FIG. 1 to FIG. 6.
Figure 10:
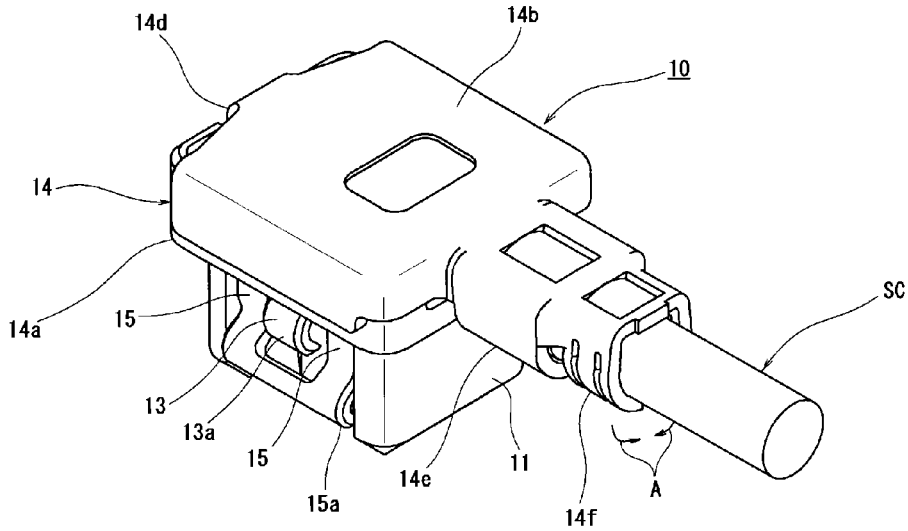
FIG. 10 is an appearance perspective explanatory view showing, from the rear side, the state in which a cover part of the electrically-conductive shell is bent and covered after the thin coaxial cable serving as the signal transmission medium is set with respect to the plug connector shown in FIG. 1 to FIG. 6.
Figure 11:
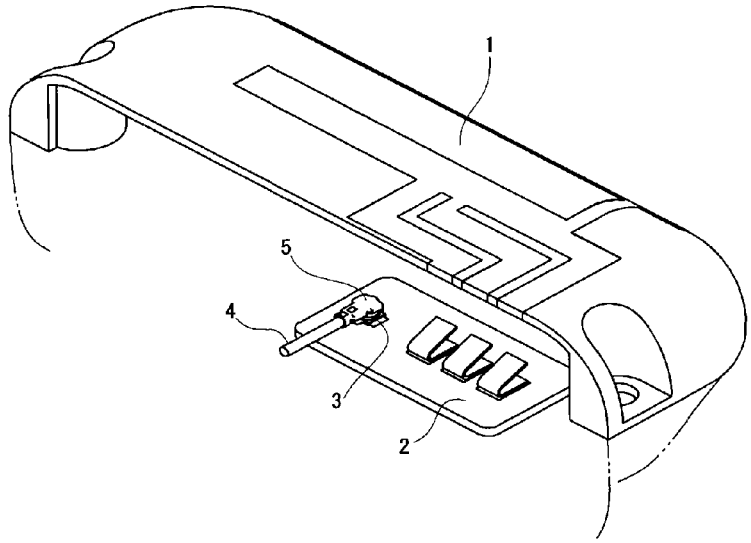
FIG. 11 is an appearance perspective explanatory view showing a connection state of a general electrical connector, which is commonly used.

In the above described open state of the electrically-conductive shell 14, the terminal part of the thin coaxial cable SC is placed and set so as to be received by the cable supporting part 14*c* as shown in FIG. 9; then, as shown in FIG. 10, the coupling plate 14*d* is bent approximately at right angle together with the insulating pressing plate 11*c*, and the shell cover part 14*b* of the electrically-conductive shell 14 is pushed down so as to be turned to an approximately horizontal state. As a result, the insulating main-body part 11*a* of the insulating housing 11 is covered with the shell cover part 14*b* from the upper side to cause the electrically-conductive shell 14 to be in a closed state.

The shell cover part 14*b* at this point is configured to cover that part so as to cover the outer peripheral surface of the shell main-body part 14*a* from the outer side and to cover the above described cable supporting part 14*c* and the thin coaxial cable SC from the outer side. More specifically, the shell cover part 14*b* is provided with a first retaining part 14*e* and a second retaining part 14*f* at the positions corresponding to the cable supporting part 14*c* and the thin coaxial cable SC so as to form a U-shape in a transverse section. The first retaining part 14*e* and the second retaining part 14*f* are formed so that the open-side parts thereof in the U-shape of the transverse section face the cable supporting part 14*c* and the thin coaxial cable SC and are configured so as to cover the cable supporting part 14*c* and the thin coaxial cable SC with a U-shape in a vertical cross section when the shell cover part 14*b* is pushed down to an approximately horizontal state in the above described manner. Then, distal-end parts of both-side plate-like members constituting the open parts of the first retaining part 14*e* and the second retaining part 14*f* thereof are bent inward as shown by arrows A of FIG. 10 and caused to be in a fixed state by swaging to bring the cable external conductor SCb into contact with the cable supporting part 14*c* and the first retaining part 14*e;* as a result, the ground circuit using the electrically-conductive shell 14 is formed.

The above described electrically-conductive ground terminals (ground contacts) 13 are disposed in both sides sandwiching the thin coaxial cable SC and are provided integrally with the shell main-body part 14*a* of the electrically-conductive shell 14. More specifically, upper-end edge parts of the shell main-body part 14*a* are disposed in both sides sandwiching the thin coaxial cable SC, and part of each of the upper-end edge parts of the shell main-body part 14*a* is bent toward the connector inner side, which is the insulating housing 11-side, and then extended so as to form a cantilever beam to the lower side. Then, the cantilever-beam-shaped part extending to the lower side from the upper-end edge part of the shell main-body part 14*a* is separated into three bodies in the front-rear direction and extended so that the bodies are mutually adjacent in this state, the cantilever-beam-shaped part disposed at the center in the adjacent direction (front-rear direction) is formed into the electrically-conductive ground terminal 13, and the pair of cantilever-beam-shaped parts disposed in both sides of the electrically-conductive ground terminal 13 are formed into connector latching plates 15.

The electrically-conductive ground terminal (ground contact) 13 and the connector latching plates 15 are disposed so that they can be inserted toward the inside of the mating hole MFa of the above described product chassis MF. In a lower-end part of the electrically-conductive ground terminal 13 among them, a contact part 13*a* bent and formed into an approximately "L" shape so as to bulge toward the outer side is provided. The contact part 13*a* of the electrically-conductive ground terminal 13 is disposed at a position corresponding to the contact part of the electrically-conductive ground path CPb exposed to the inner-peripheral wall surface of the mating hole MFa, and electrical connection is configured to be established when both of the contact parts are brought into contact with each other with pressure by the elastic displacing action caused by the cantilever-beam-shaped structure of the electrically-conductive ground terminal 13.

On the other hand, each of the connector latching plates 15 is extended to the lower side along the above described electrically-conductive ground terminal (ground contact) 13, and the pair of connector latching plates 15, 15 are provided to be adjacent to each other so as to sandwich the electrically-conductive ground terminal 13 from both sides in the front-back direction. The lower end part of each of the connector latching plates 15 is formed so as to be extended to further lower side than the contact part 13*a* of the electrically-conductive ground terminal 13, and the lower-end part of the connector latching plate 15 is provided with a lock part 15*a* bent and formed into an approximately "L" shape so as to bulge outward.

The lock part 15*a* provided in the connector latching plate 15 is formed so as to be further projected to the lower side from a lower-end-side opening of the mating hole MFa, and an inclined surface part bulged to the outer side of the lock part 15*a* is disposed at a position corresponding to the opening edge of the mating hole MFa. A fixing action is configured to be carried out when both of the contact parts are brought into contact with each other with pressure by the elastic displacing action caused by the cantilever-beam-shaped structure of the connector latching plate 15. By virtue of such a configuration, when the plug connector 10 is mated with the product chassis MF to complete mating, a clicking sensation can be obtained by the lock part 15a provided in the connector latching plate 15.

At this point, the lock parts 15*a*, 15*a* of the above described pair of connector latching plates 15, 15 are integrally coupled to each other by lower end parts thereof, and the coupling part is formed so as to be extended along the extending direction of the thin coaxial cable SC. By virtue of the configuration in which the lock parts 15*a*, 15*a* are coupled to each other, the pair of connector latching plates 15, 15 is configured to surround the periphery of the electrically-conductive ground terminal (ground contact) 13, and the pair of connector latching plates 15, 15 and the electrically-conductive ground terminal 13 are formed so as to be cut from one plate-shaped member. When the plug connector 10 is mated with the product chassis MF, the lock part 15*a* of the connector latching plate 15 is brought into contact with the electrically-conductive ground path CPb exposed from the inner-peripheral wall surface of the mating hole MFa; therefore, the electrically-conductive ground terminal 13 is brought into contact with the wiring pattern CP before the electrically-conductive signal terminal 12, and the ground circuit can be caused to work as a protection circuit.

On the other hand, as described above, the electrically-conductive signal terminal (signal contact) 12 for transmitting signals is attached to the insulating main-body part 11*a* of the insulating housing 11, for example, by press-fitting or insert molding, and the above described electrically-conductive ground terminals (ground contacts) 13, 13 for grounding are configured to be disposed in both sides of the electrically-conductive signal terminal 12.

Figure 5:
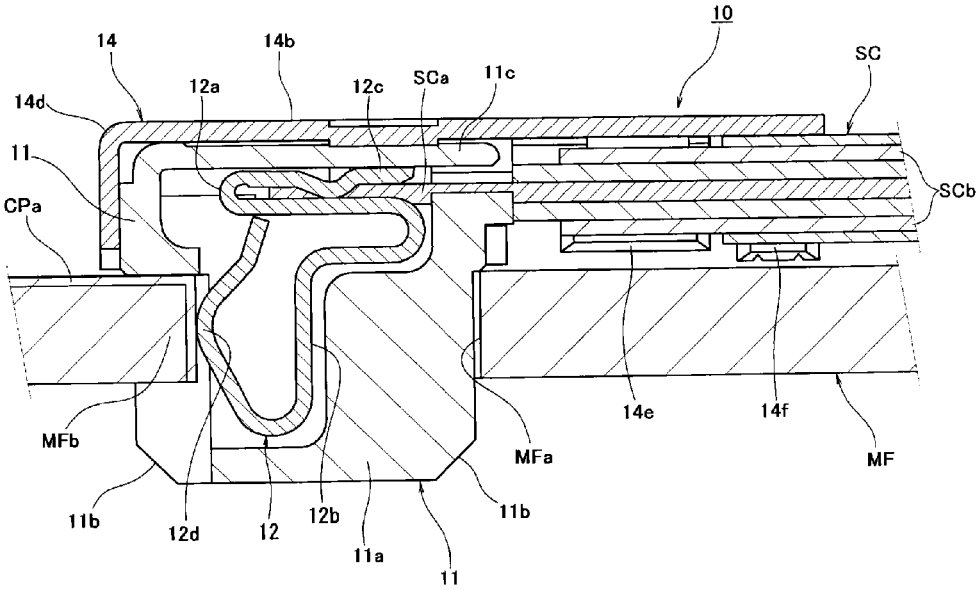
FIG. 5 is a vertical cross-sectional explanatory view taken along a line V-V in FIG. 4.
Figure 6:
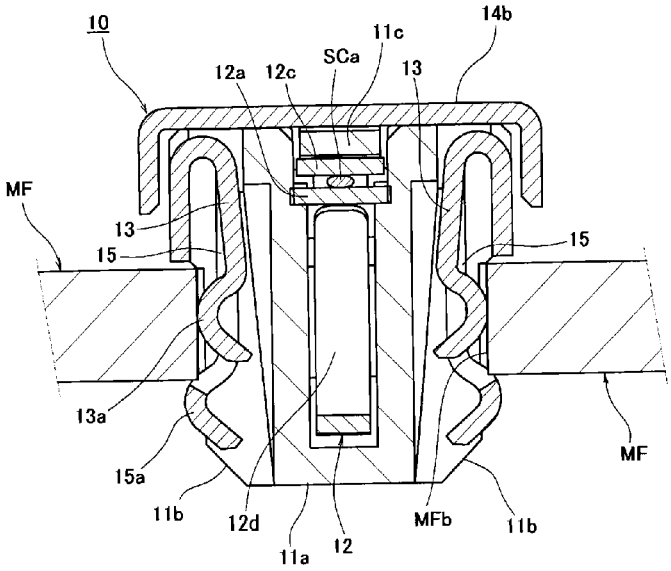
FIG. 6 is a vertical cross-sectional explanatory view taken along a line VI-VI in FIG. 4.

Particularly as shown in FIG. 5, the electrically-conductive signal terminal (signal contact) 12 at this point has: a cable sandwiching part 12*a*, which is connected to the cable central conductor (signal line) SCa of the above described thin coaxial cable SC, and an elastic spring part 12*b*, which is extended in a curved shape from the cable sandwiching part 12*a* toward the lower side and brought into contact with the electrically-conductive signal path CPa of the wiring pattern CP.

Among them, the cable sandwiching part 12*a* has a clip beam structure, which is bent and formed to have an approximately U-shape in a lateral view, and is formed so as to sandwich the cable central conductor (signal line) SCa of the thin coaxial cable SC like clipping from the upper and lower sides. A recessed part, which presses the cable central conductor (signal line) SCa from the upper side is provided at an intermediate part of an upper beam part 12*c* constituting the cable sandwiching part 12*a*. Moreover, a latch fixing part (illustration omitted) for carrying out latching with the insulating housing 11 is provided at a position in the lower side opposed to the recessed part, which is provided in the upper beam part 12*c*, with the cable central conductor SCa interposed therebetween. Furthermore, the electrically-conductive signal terminal 12 is extended from the latch fixing part to the rear side, is then bent to the lower side, is then extended again to the front side up to about a position of the latch fixing part, and then bent to the lower side and extended to the elastic spring part 12*b*.

In an initial state before coupling the above described terminal part of the thin coaxial cable SC, the upper beam part 12*c* of the cable sandwiching part 12*a* is in the open state, for example, as shown in FIG. 7 and FIG. 9. More specifically, the upper beam part 12*c* in the initial state has a shape that rises obliquely upward. In the state in which the terminal part of the thin coaxial cable SC is placed and set on the cable supporting part 14*c* as shown in FIG. 9, if the shell cover part 14*b* of the electrically-conductive shell 14 is pushed down so as to be turned to an approximately horizontal state together with the insulating pressing plate 11*c* as shown in FIG. 10, the upper beam part 12*c* of the cable sandwiching part 12*a* is configured to be pushed down to an approximately horizontal state by the insulating pressing plate 11*c* and press the cable central conductor (signal line) SCa from the upper side.

The elastic spring part 12*b* of the electrically-conductive signal terminal (signal contact) 12 is formed so as to be once extended to the lower side from the above described cable sandwiching part 12*a* in the insulating main-body part 11*a* and rise again to the upper side so as to form a cantilever-beam shape. The contact part 12*d*, which is brought into contact with the contact part of the electrically-conductive signal path CPa provided in the projected part MFb of the above described mating hole MFa, is formed at an intermediate part of the upward rising part of the elastic spring part 12*b* so as to be bulged toward the front. The contact part 12*d* is configured so as to be brought into contact with pressure with respect to the contact part of the electrically-conductive signal path CPa by the elastic displacing action of the elastic spring part 12*b*, which forms the above described cantilever-beam shape.

In this manner, in the present embodiment, the single plug connector 10 is configured to be directly mated with the wall part of the product chassis MF. In the mated state of the single plug connector 10, the contact parts 12*d* and 13*a* of the electrically-conductive signal terminal (signal contact) 12 and the electrically-conductive ground terminals (ground contacts) 13 are brought into contact with the contact parts of the electrically-conductive signal path CPa and the electrically-conductive ground path CPb of the wiring pattern CP, which are exposed from the inner-peripheral wall part of the mating hole MFa. Therefore, electrical connection of the signal transmission medium can be established with a simple configuration without intermediation of a conventionally-used circuit board or electrical connector (receptacle connector) serving as a mating counterpart mounted on the circuit board.

Moreover, in the present embodiment, the connector latching plate 15 is extended along the electrically-conductive ground terminal (ground contact) 13; therefore, the contact part 13*a* of the electrically-conductive ground terminal 13 is stably supported by the connector latching plates 15 disposed in the vicinity thereof so that the electrical connection state of the electrically-conductive ground terminal 13 is stably maintained.

Moreover, in the present embodiment, the lock parts 15*a* provided in the connector latching plate 15 are formed so as to be extended along the extending direction of the thin coaxial cable SC serving as the signal transmission medium; therefore, the retaining force of the lock parts 15*a* is generated lengthwise along the extending direction of the thin coaxial cable SC. Therefore, for example, the retainability against the load that lifts up and swings the thin coaxial cable SC is enhanced, and the mating state of the plug connector 10 is stably maintained.

Moreover, in the present embodiment, the electrically-conductive ground terminals (ground contacts) 13, 13 for grounding are configured to be disposed in both sides of the electrically-conductive signal terminal (signal contact) 12. Therefore, impedance adjustment against the electrically-conductive signal terminal 12 is configured to be well performed.

Hereinabove, the invention accomplished by the present inventor has been described in detail based on the embodiment. However, the present embodiment is not limited to the above described embodiment, and it goes without saying that various modifications can be made without departing from the gist thereof.

For example, in the above described embodiment, the mating hole MFa formed in the surface of the wall part of the product chassis MF is formed of a cornered hole. However, the hole can be formed to have various shapes such as a round hole having an approximately circular shape in a plane or can be a hole that does not penetrate through the wall part of the product chassis MF. Moreover, since the lock parts 15*a* of the connector latching plate 15 and the electrically-conductive ground terminal (ground contact) 13 are integrally formed, the lock parts 15*a* can be used as grounding members, a ground circuit can be increased by providing an electrically-conductive ground path also at the contact position of the lock part 15*a* and the inner wall surface of the mating hole MFa, and EMI effects and transmission characteristics can be improved.

Moreover, in the above described embodiment, the present invention is applied to the electrical connector of the vertical mating type. However, the present invention can be similarly applied also to an electrical connector of a horizontal mating type.

Furthermore, the present invention is not limited to a single connector for a thin coaxial cable like the above described embodiment, but can be similarly applied to, for example, a connector for a thin coaxial cable disposed to have multiple electrodes, an electrical connector of a type that a plurality of thin coaxial cables and insulating cables are mixed, and an electrical connector coupled to, for example, a flexible wiring board.

As described above, the present embodiment can be widely applied to wide varieties of electrical connectors used in various electric devices.

REFERENCE SIGNS LIST

10 Plug connector
11 Insulating housing
11*a* Insulating main-body part
11*b* Insulating guiding part
11*c* Insulating pressing plate
12 Electrically-conductive signal terminal (signal contact)
12*a* Cable sandwiching part
12*b* Elastic spring part
12*c* Upper beam part
12*d* Contact part
13 Electrically-conductive ground terminal (ground contact)
13*a* Contact part
14 Electrically-conductive shell
14*a* Shell main-body part
14*b* Shell cover part
14*c* Cable supporting part
14*d* Coupling plate
14*e* First retaining part
14*f* Second retaining part
15 Connector latching plate
15*a* Lock part
SC Thin coaxial cable (signal transmission medium)
SCa Cable central conductor (signal line)
SCb Cable external conductor (shield line)
MF Product chassis
MFa Mating hole
MFb Projected part
CP Wiring pattern
CPa Electrically-conductive signal path
CPb Electrically-conductive ground path

The invention claimed is:

1. An electrical connector electrically connecting a terminal part of a signal transmission medium to a wiring pattern formed on a surface of a wall part of a product chassis constituting an electronic device having a predetermined circuit, wherein a contact having a contact part elastically in contact with the wiring pattern is attached to an insulating housing; wherein the insulating housing is configured to be able to be inserted into and mated with a mating hole formed in the wall part of the product chassis, the wiring pattern is provided with a contact part exposed from an inner-peripheral wall surface of the mating hole, and the contact part of the contact is configured to be in contact with the contact part of the wiring pattern in a state that the insulating housing is mated with the mating hole.

2. The electrical connector according to claim 1, wherein the mating hole is formed so as to penetrate through the wall part of the product chassis, a lock part engaged with an opening edge part of the mating hole is provided, and the lock part is disposed so as to be adjacent to the contact.

3. The electrical connector according to claim 2, wherein the lock part is formed so as to be extended along an extending direction of the signal transmission medium.

4. The electrical connector according to claim 1, wherein the contact is composed of a signal contact for transmitting a signal and ground contacts for grounding disposed in both sides of the signal contact.

5. An electrical connector assembly comprising:

a product chassis constituting an electronic device having a predetermined electronic circuit and having a wiring pattern formed to transmit a signal onto a surface of a wall part; and the electrical connector according to any of claim 1 to claim 4.

* * * * *